United States Patent [19]

Chang

[11] Patent Number: 5,047,610

[45] Date of Patent: Sep. 10, 1991

[54] BUILT-UP TYPE ELECTRIC HEAT-CONVECTION STOVE

[76] Inventor: Kwei T. Chang, No. 14, Lane 54, Luong Chuan St., Panchiao, Taipei Hsien, Taiwan

[21] Appl. No.: 532,540

[22] Filed: Jun. 4, 1990

[51] Int. Cl.[5] ..... A21B 1/26; F27B 1/00

[52] U.S. Cl. ..... 219/400; 126/21 A; 126/21 R

[58] Field of Search ..... 219/400; 126/21 A, 21 R; 34/223, 230

[56] References Cited

U.S. PATENT DOCUMENTS

| | | | |
|---|---|---|---|
| 3,999,475 | 12/1976 | Roderick | 126/21 A |
| 4,350,874 | 9/1982 | Nishikawa | 219/400 |
| 4,908,488 | 3/1990 | Park | 219/10.55 R |

*Primary Examiner*—Bruce A. Reynolds
*Assistant Examiner*—To Tuan
*Attorney, Agent, or Firm*—Lowe, Price, LeBlanc, Becker & Shur

[57] ABSTRACT

Disclosed is an electric heat-convection stove, which is comprised of a base having set therein a heat-convection mechanism covered with a transparent hood of reinforcing glass and defining therein a roasting chamber for cooking, which transparent hood is built up with four zinc alloy posts, a front panel, three side boards and a top board, with the gap therebetween well sealed with silicone rubber strips. A perforated tray is mounted on the heat-convection mechanism for circulation of heat current and for collection of grease. Transverse notches are made on the zinc alloy posts at different level positions for adjustably mounting a grill inside the hood to hold something for roasting. The front panel is pivoted to the base so that it can be conveniently opened for putting something in or removing something from the grill.

1 Claim, 5 Drawing Sheets

BUILT-UP TYPE ELECTRIC HEAT-CONVECTION STOVE

BACKGROUND AND SUMMARY OF THE INVENTION

The present invention is related to electric stoves and more particularly to a built-up type electric heat-convection stove which comprises a base covered with a transparent hood with a releasable perforated tray set therein for heat-convection as well as for grease collection.

Regular heat-convection stoves are generally of fixed type not suitable for cleaning. The housing of the variety of conventional heat-convection stoves is generally comprised of an opaque top board, a plurality of opaque side boards and a transparent liftable front panel. While cooking, the cooking process inside the housing can not be easily seen therethrough from the outside.

It is therefore, an object of the present invention to provide an electric heat-convection stove which can be conveniently detached and re-assembled. Another object of the present invention is to provide an electric heat-convection stove in which the cooking process can be clearly seen from the outside.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
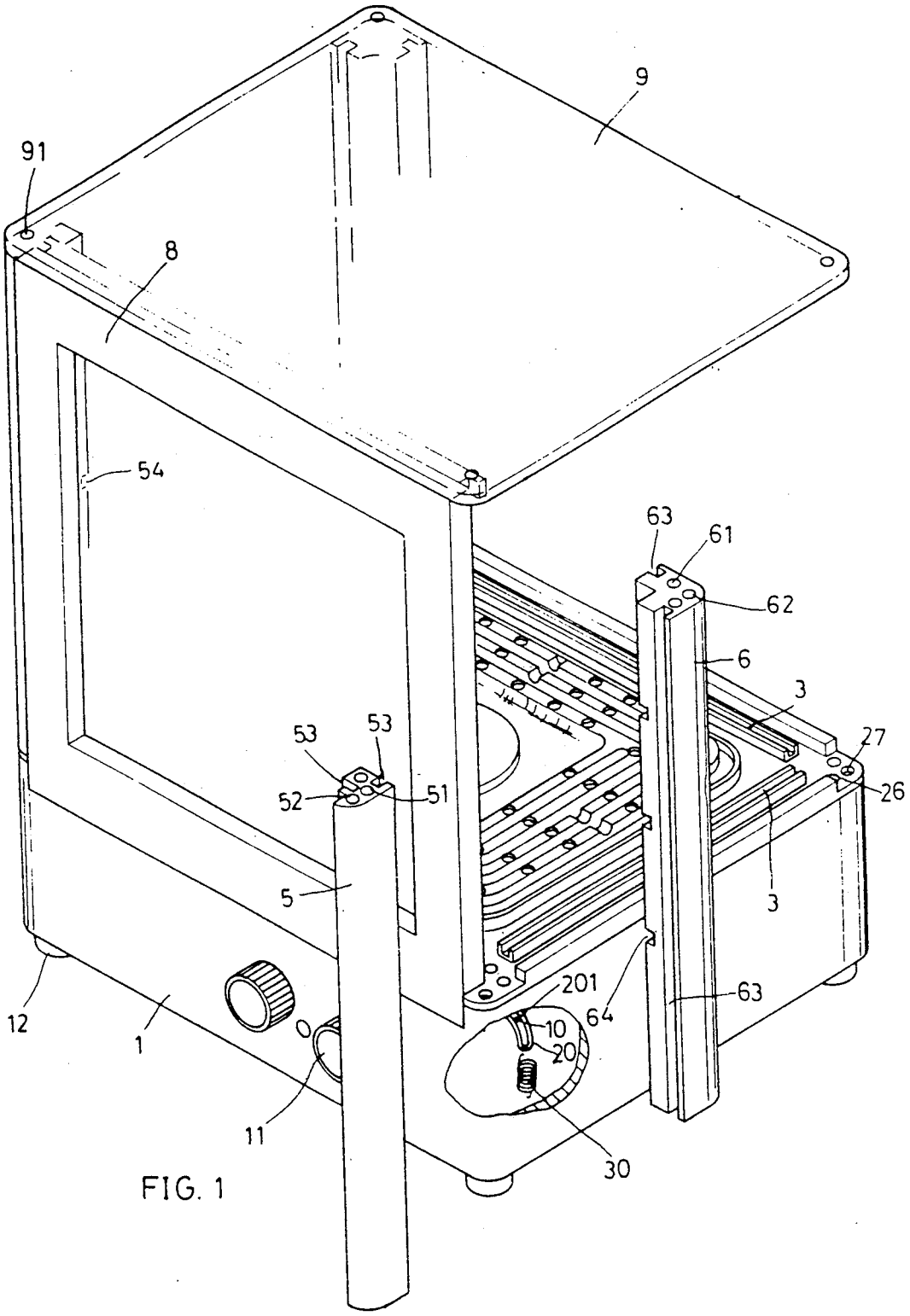
FIG. 1 is a perspective fragmentary view of an electric heat-convection stove embodying the present invention.
Figure 2:
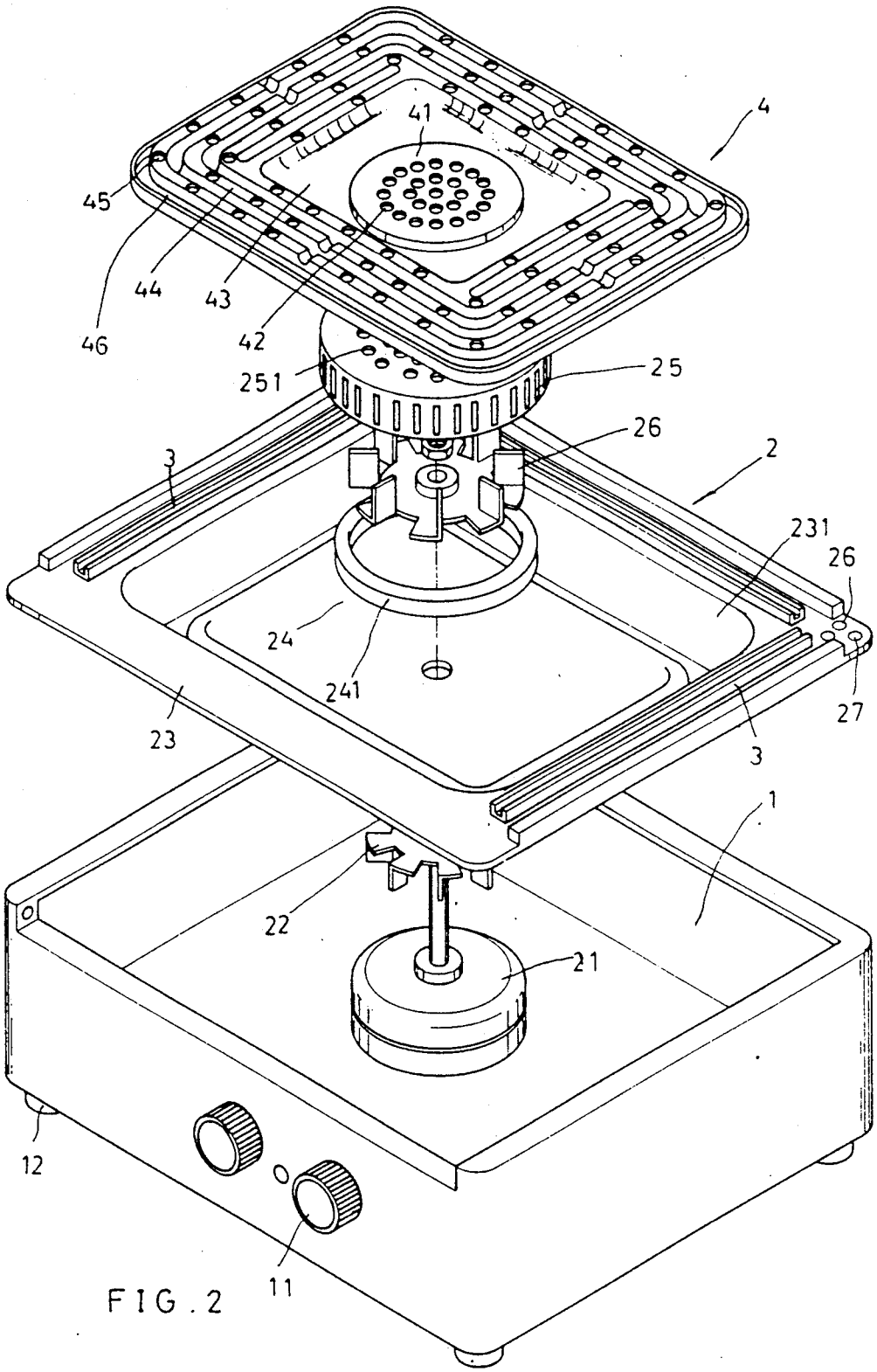
FIG. 2 is a partly perspective exploded view thereof.
Figure 3:
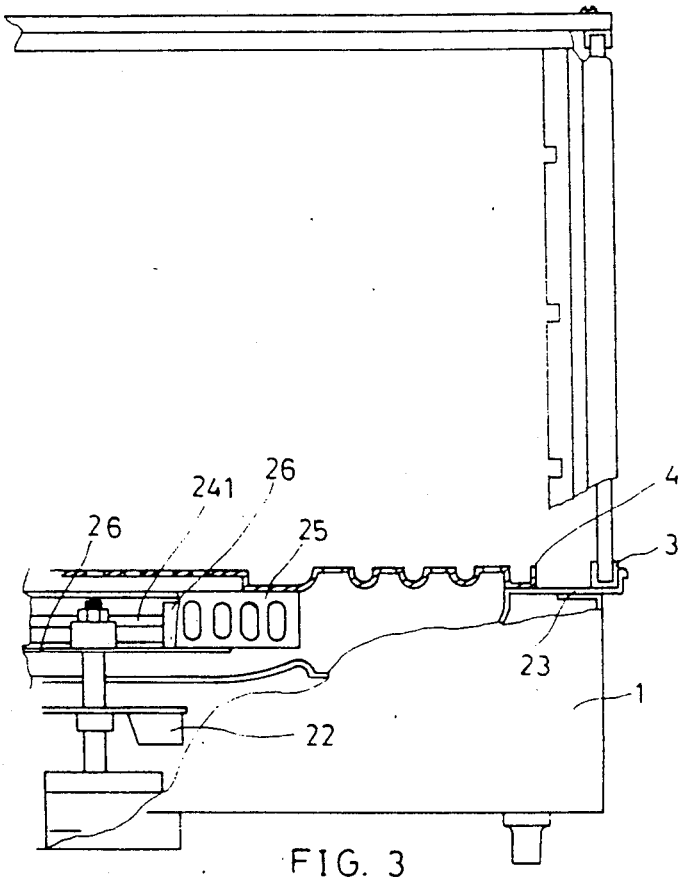
FIG. 3 is a partly side sectional plain view thereof.

Referring to the annexed drawings in greater detail, there is illustrated an embodiment of electric heat-convection stove according to the present invention, which is generally comprised of a base 1, a heat-convection mechanism 2, a plurality of silicone rubber strips 3, a perforated tray 4, two front zinc alloy posts 5, two rear zinc alloy posts 6, three side boards 7, a front panel 8, and a top cover 9.

As illustrated, the base 1 is supported by a plurality of stands 12 and comprises a plurality of control switches 11 through which the operation of the stove can be conveniently controlled.

The heat-convection mechanism 2 is comprised of a motor 21, a first fan 22 for heat radiation, a pan 23, a heating coil holder 24 having set therein a heating coil 241, a protective cap 25 and a second fan 26 for output of heat current. The motor 21 is vertically fastened inside the base 1 to drive the first and second fans 22 and 26 to rotate. The pan 23 is mounted in the base 1 and set between the first and second fans 22 and 26. The heating coil 24 is mounted on the top of the pan 3 and covered by the protective cap 25 which has a plurality of vent holes 251 for passing heat current. The pan 23 comprises a plurality of raised portions 26 and round holes 27 on the four corners thereof.

The silicone rubber strips 3 are respectively mounted on the edge of the side glass boards 7 to seal the gap.

The perforated tray 4 comprises a recessed portion 41 surrounded by a plurality of channels 46. A plurality of vent holes 45 for heat current output are made on the rails 44 which are defined between the channels 46 and the recessed portion 41. A circular raised portion 41 is defined at the center of the recessed portion 43, which comprises a plurality of vent holes 42 for heat current input. During assembly, the perforated tray 4 is mounted on the top of the base 1 for heat convection therethrough and for collecting any grease from cooking food.

The two front zinc alloy posts 5 are identical in structure, having each two vertical channels 53 for mounting the front panel 8 and the side glass boards 7, a plurality of recessed holes 51 and bolt holes 52 on the top and bottom edges thereof, and a plurality of side notches 54 for mounting a grill.

The two rear zinc alloy posts 6 are identical in structure and similar to the front zinc alloy posts, having each two vertical channels for mounting the side glass boards 7, a plurality of recessed holes 61 and bolt holes 62 on the top and bottom edges thereof, and a plurality of side notches 64 for mounting a grill.

The side boards 7 are made of reinforcing glass mounted between the front and rear zinc alloy posts 5 and 6 or between the two rear zinc alloy posts 6 with the silicone rubber strips 3 attached thereto to seal the gap between the pan 23 and the top cover 9.

Figure 4:
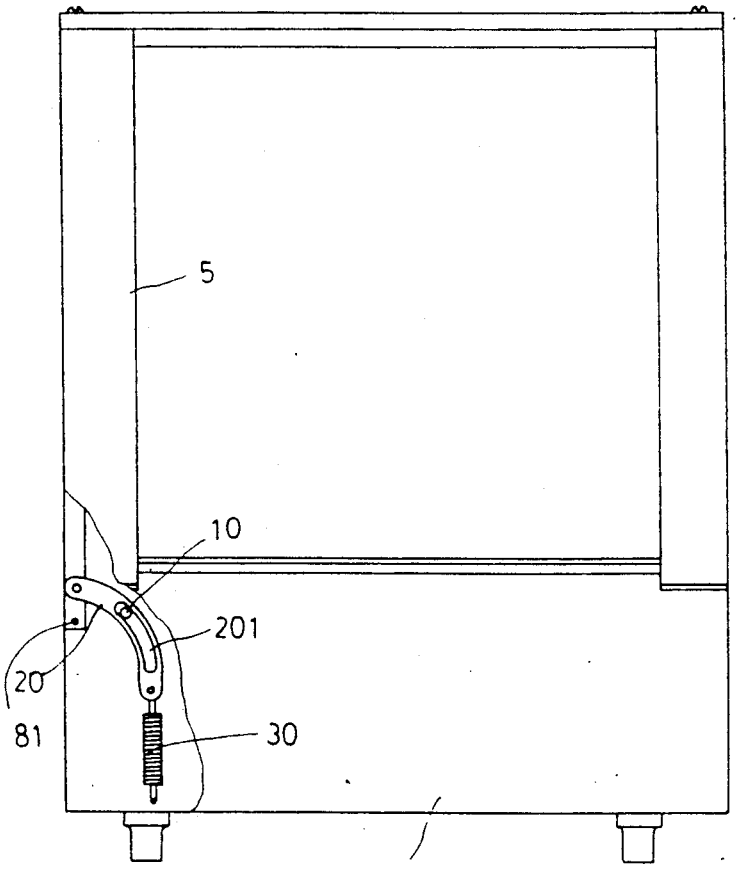
FIG. 4 is another partly side sectional plain view thereof.
Figure 5:
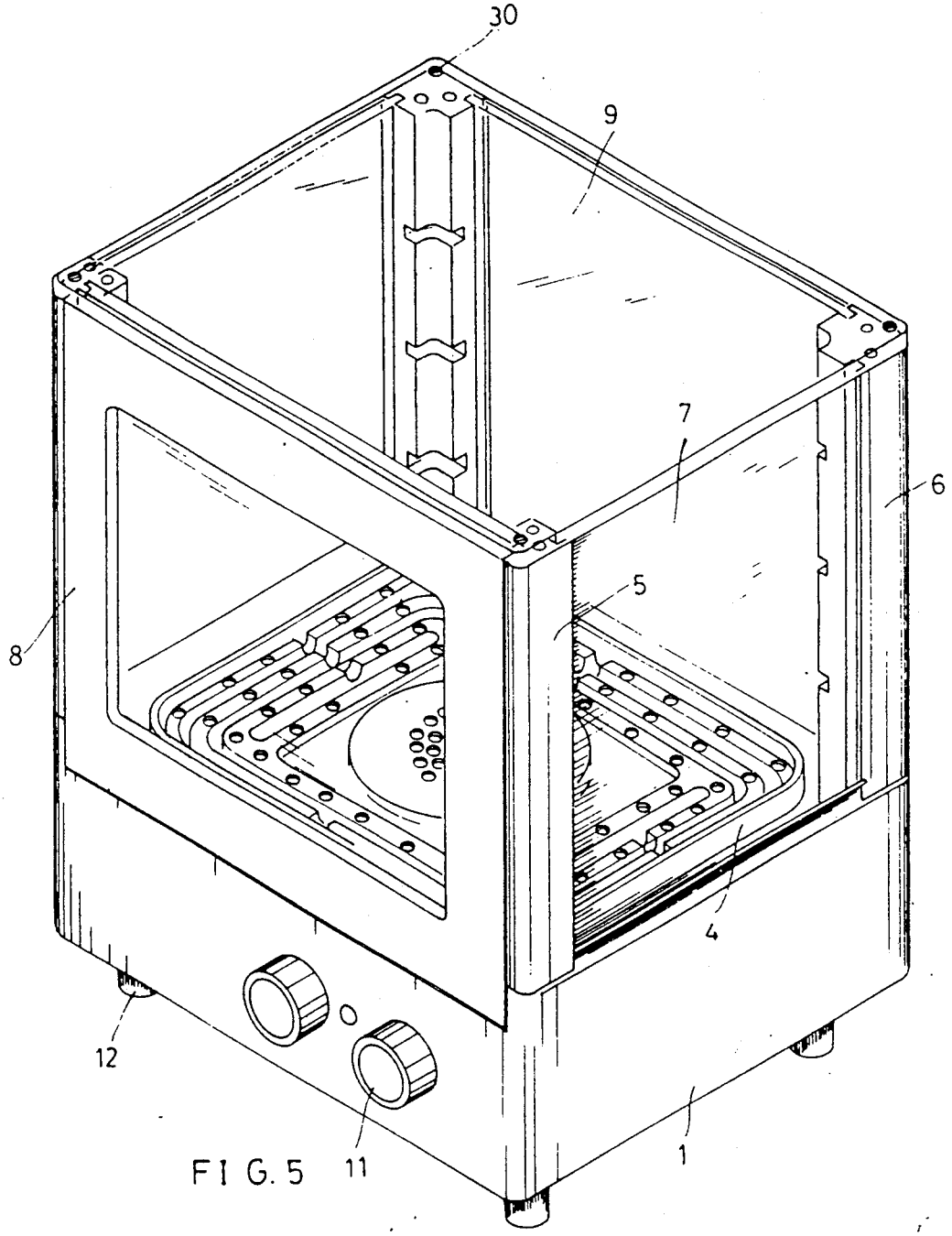
FIG. 5 is a perspective view of the present invention.

The front panel 8 comprises two unitary side bolts 81 and the lower ends of the two opposite sides thereof and respectively fastened in the base 1 at the front side, and two sliding stays 20 at the two opposite sides thereof right above the side bolts 81 and respectively secured to the base 1 through two springs 30, which two sliding stays 20 are each comprised two relatively movable parts with a bolt 10 on the first part set to slide in a slot 201 on the second part (see FIG. 4).

The top cover 9 is made of reinforcing glass and comprises a plurality of round holes 91 on the four corners thereof through which screw means 30 are fastened in the bolt holes 52 and 62 at the top edges of the front and rear zinc alloy post 5 and 6 to secure the top cover 9 to the posts 5 and 6 after the posts 5 and 6 are respectively mounted on the top of the base 1 at the four corners thereof.

As described above, the front zinc alloy post 5 or the rear zinc alloy posts are identical in structure, they can be turned upside-down during installation or positioned either at the left side or the right side. The side glass boards 7, the top cover 9 and the front panel 8 are all made of reinforcing, transparent glass material through which the food which is under cooking can be clearly seen from the outside. Since the front and rear zinc alloy posts 5 and 6 have each a plurality of side notches 54 and 64 respectively made at different level positions, a grill can be conveniently adjustably mounted on the posts 5 and 6 at a preferred height for holding something to be roasted. By means of the design of the raised portions 26 on the four corners of the pan 23 to respectively match with the recessed holes 51 and 61 on the two opposite ends of the posts 5 and 6, the posts 5 and 6 can be conveniently mounted on the pan 23 at the four corners thereof. Because the perforated tray 4 is bridged over the pan 23, input and output heat currents are permitted to pass therethrough for heat-convection while it is serving as a grease collector. In general, the parts of the whole assembly can be conveniently detached and re-assembled and the perforated tray can be conveniently removed for wash.

When the motor is started, heat current from the heating coil 241 is blown by the second fan 26 and guided by a guide board 231 on the pan 23 to run through the output vent holes 45 of the perforated tray into the space defined by the front panel 8, the top cover 9 and the side boars 7 for roasting something. The heat current is further running through the input vent holes 42 of the perforated tray and the vent holes 251 of the protective cap 25 for further circulation.

What is claimed is:

1. An electric heat-convection stove, comprising:

a base;

a heat-convection mechanism comprised of a motor vertically fastened inside said base, a first fan for heat radiation and a second fan for output of a heat current respectively driven by said motor to rotate, a pan mounted on the top of said base and set between said first and second fans, a heating coil mounted on said pan covered with a protective cap, and a perforated tray mounted on the top of said pan and covering over said protective cap, said perforated tray comprising a recessed portion surrounded by a plurality of channels, said channels defining therebetween a plurality of rails having a plurality of vent holes thereon for heat current output, said recessed portion comprising a circular raised portion at the center said circular raised portion having a plurality of vent holes thereon for heat current input, said pan comprising a plurality of raised portions and round holes on the four corners thereof; and a hood mounted on said base and defining therein a roasting chamber, said roast chamber being comprised of four zinc alloy posts having each a plurality of recessed holes and raised portions at the two opposite ends thereof corresponding to the raised portions and recessed holes on said pan for fastening, a front panel, three side boards and a top cover, and a plurality of silicone rubber for sealing the gap between said side boards and said top cover and the gap between said side boards and said pan, said front panel, side boards and top cover being made of transparent, reinforcing glass material. said front panel comprising two unitary side bolts and two sliding stays at the lower ends of the two opposite sides thereof and respectively fastened in said base.

* * * * *